US008387401B2

(12) United States Patent
Hashimoto et al.

(10) Patent No.: US 8,387,401 B2
(45) Date of Patent: Mar. 5, 2013

(54) COOLING PASSAGE COVER, MANUFACTURING METHOD OF THE COVER, AND GAS TURBINE

(75) Inventors: Shinya Hashimoto, Hyogo (JP); Kenichi Arase, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 12/934,036

(22) PCT Filed: Jan. 15, 2009

(86) PCT No.: PCT/JP2009/050438

§ 371 (c)(1), (2), (4) Date: Sep. 22, 2010

(87) PCT Pub. No.: WO2009/119133

PCT Pub. Date: Oct. 1, 2009

(65) Prior Publication Data

US 2011/0016884 A1 Jan. 27, 2011

(30) Foreign Application Priority Data

Mar. 28, 2008 (JP) ..... 2008-088750

(51) Int. Cl.
*F02C 7/12* (2006.01)

(52) U.S. Cl. ..... 60/806; 415/115

(58) Field of Classification Search ..... 60/782, 60/785, 796–800, 806; 415/115; 416/96 R, 416/97 R See application file for complete search history.

(56) References Cited

U.S. PATENT DOCUMENTS

| | | | | |
|---|---|---|---|---|
| 2,656,147 | A * | 10/1953 | Brownhill et al. | 416/97 R |
| 3,945,758 | A * | 3/1976 | Lee | 415/144 |
| 5,755,556 | A * | 5/1998 | Hultgren et al. | 416/96 R |
| 6,224,327 | B1 | 5/2001 | Aoki et al. | |
| 6,457,935 | B1 * | 10/2002 | Antunes et al. | 415/115 |
| 2004/0163394 | A1 * | 8/2004 | Marushima et al. | 60/806 |

FOREIGN PATENT DOCUMENTS

| | | | |
|---|---|---|---|
| JP | 62-169201 | U | 10/1987 |
| JP | 11-229804 | A | 8/1999 |
| JP | 11-257012 | A | 9/1999 |
| JP | 2001-329859 | A | 11/2001 |

OTHER PUBLICATIONS

ISR for PCT/JP2009/050438 mailed Feb. 17, 2009.
Japanese Decision to Grant for Application No. 2008-088750 mailed Oct. 9, 2012.

* cited by examiner

*Primary Examiner* — Phutthiwat Wongwian
(74) *Attorney, Agent, or Firm* — Lowe Hauptman Ham & Berner, LLP

(57) ABSTRACT

A cover for a cooling passage is disclosed forming a cooling passage for supplying cooling air to a turbine rotor blade at the last stage via inside of a disk of a turbine, and the cover includes a cylindrical cover portion that covers a cavity provided in a annular pattern in an outer circumference of the disk in a mode where a first passage opened from inside of the disk to the cavity and a second passage opened from a cooling passage of the turbine rotor blade at the last stage to the cavity are connected to each other; and a flexible portion that is formed integrally with the cover portion and allows flexure in an axial direction of the turbine.

7 Claims, 6 Drawing Sheets

COOLING PASSAGE COVER, MANUFACTURING METHOD OF THE COVER, AND GAS TURBINE

RELATED APPLICATIONS

The present application is national phase of International Application Number PCT/JP2009/050438 filed Jan. 15, 2009, and claims priority from, Japanese Application Number 2008-088750 filed Mar. 28, 2008.

TECHNICAL FIELD

The present invention relates to a cover of a cooling passage that forms a cooling passage for supplying cooling air for cooling turbine rotor blades of a gas turbine, a method of manufacturing the cover, and a gas turbine having the cover.

BACKGROUND ART

A gas turbine includes a compressor, a combustor, and a turbine. The compressor compresses air taken in from an air inlet, and generates high-temperature and high-pressure compressed air. The combustor supplies fuel to the compressed air to burn the fuel, and generates high-temperature and high-pressure combustion gas. In the turbine, a plurality of turbine nozzles and a plurality of turbine rotor blades are alternately arranged in a casing. The turbine rotor blades are driven by the combustion gas supplied to an exhaust passage, to rotate, for example, a rotor connected to a power generator. The combustion gas that has driven the turbine is released into the atmosphere after dynamic pressure thereof is converted to static pressure by a diffuser.

In a gas turbine thus configured, combustion gas acting on the turbine rotor blades is high-temperature gas. Therefore, compressed air is taken from the compressor to outside, the air is cooled by an external cooler to generate cooling air, and the turbine rotor blades are cooled by supplying the cooling air thereto.

When the cooling air is supplied from the external cooler to the turbine rotor blades, a cooling passage is provided. For example, in a cooling passage that introduces cooling air from a downstream side of the rotor to turbine rotor blades at the last stage, there can be considered a configuration such that a cooling passage extends along a rotation shaft of a rotor to a center of a disk of the turbine rotor blades at the last stage, and then extends radially outward to lead to the turbine rotor blades at the last stage. However, in this configuration, because the cooling passage extends long from the center of the disk to the turbine rotor blades at the last stage and radially outward, the strength of the disk decreases, which is not desired.

Therefore, in order not to decrease the strength of the disk, in a cooling passage shown in FIG. 6, a first passage 51 extending radially outward from the center of the disk is opened and formed in a cavity 53 provided in a annular pattern in an outer circumference of a disk 35, and a second passage 52 leading to turbine rotor blades 33*a* at the last stage (hereinafter, "the last-stage turbine rotor blades 33*a*") and open to the cavity 53 is formed in the disk 35 that fixes the last-stage turbine rotor blades 33*a*. A cylindrical cooling passage cover 55 that covers the cavity 53 so as to connect respective passages 51 and 52 is provided in the outer circumference of the disk 35. In this configuration, a cooling passage 5 is divided into the first passage 51 and the second passage 52, and respective passages are formed short in the radial direction. Therefore, a decrease in the strength of the disk 35 can be prevented.

Meanwhile, when the cooling passage 5 is formed as shown in FIG. 6, a temperature difference between an upstream side (a front side) and a downstream side (a rear side) of a flow of combustion gas in the turbine centering on the cavity 53 is large, and thus distortion occurs in the cavity 53 in an axial direction of the turbine. Further, because opposite ends of a rotor 4 are supported by bearings and a central part of the rotor 4 deforms in a radial direction of the turbine due to a centrifugal force, an upstream side and a downstream side of the cavity 53 present in the outer circumference of the disk 35 constituting the rotor 4 deform so as to approach or be separated from each other in the axial direction of the turbine. Therefore, a function of absorbing the distortion due to the temperature difference and deformation due to the centrifugal force needs to be provided to the cooling passage cover 55.

Conventionally, to absorb an extension amount due to thermal deformation, there has been known a gas turbine provided with a sealing member in a sliding portion in an axial direction of a turbine (see, for example, Patent Document 1). As shown in FIG. 6, it can be assumed that the cooling passage cover 55 is divided into an upstream side and a downstream side in the axial direction of the turbine and a sealing member 551 is provided to allow a sliding movement in the axial direction of the turbine between the upstream side and the downstream side.

Patent Document 1: Japanese Patent Application Laid-open No. H11-229804

DISCLOSURE OF INVENTION

Problem to be Solved by the Invention

However, in the cooling passage cover 55 shown in FIG. 6, because the sealing member 551 is provided to allow a sliding movement, leakage of cooling air tends to occur in the sliding portion, and in a case of a combined cycle in which a steam generator and a steam turbine are combined on a downstream side of a gas turbine, efficiency thereof deteriorates. Further, because the sealing member 551 is worn due to sliding, the sealing member 551 needs to be replaced frequently, operation costs required for disassembly and assembly of the turbine are increased, and the replacement requires a time where operations of the gas turbine are stopped.

The present invention has been achieved to solve the above problems, and an object of the present invention is to provide a cooling passage cover that can reduce leakage of cooling air and can be used for a long time without requiring replacement parts, a method of manufacturing the cover, and a gas turbine.

Means for Solving Problem

According to an aspect of the present invention, a cover of a cooling passage that forms a cooling passage for supplying cooling air to a turbine rotor blade via inside of a disk of a turbine, includes: a cylindrical cover portion that covers a cavity provided in a annular pattern in an outer circumference of the disk in a mode where a first passage opened from inside of the disk to the cavity and a second passage opened from a cooled part of the turbine rotor blade to the cavity are connected to each other; and a flexible portion that is formed integrally with the cover portion and allows flexure in an axial direction of the turbine.

Even if distortion due to a temperature difference or deformation due to a centrifugal force occurs in the cavity, the cooling passage cover can absorb the distortion and the deformation, because the flexible portion bends in the axial direction of the turbine. Therefore, as compared with conventionally assumable cooling passage covers, leakage of the cooling air can be reduced, and the cover can be used for a long time without requiring replacement parts such as a sealing member.

Advantageously, in the cover of a cooling passage, the flexible portion is formed by a peripheral wall of the cover portion bulging radially outward and formed thinner than the cover portion.

In the cooling passage cover, because the flexible portion bulges radially outward, even if the cooling passage cover is inserted along a central axis of the rotor, the flexible portion does not interfere, and the cover can be attached to the rotor.

Advantageously, in the cover of a cooling passage, a drain hole is provided in the bulging part.

In the cooling passage cover, droplets adhered to inside of the cooling passage cover due to dew condensation can be discharged without being accumulated in the flexible portion bulging radially outward.

Advantageously, in the cover of a cooling passage, the flexible portion is formed by a peripheral wall of the cover portion extending radially outward and formed thinner than the cover portion.

In the cooling passage cover, because the peripheral wall of the cover portion extends radially outward to form the flexible portion, droplets adhered to inside of the cooling passage cover due to dew condensation do not accumulate in the flexible portion.

According to another aspect of the present invention, a method of manufacturing a cover of a cooling passage that forms a cooling passage for supplying cooling air to a turbine rotor blade via inside of a disk, and that includes a cylindrical cover portion that covers a cavity provided in a annular pattern in an outer circumference of the disk of a turbine, in a mode where a first passage opened from inside of the disk to the cavity and a second passage opened from the disk that fixes the turbine rotor blade to the cavity are connected to each other, includes: a step of cutting a fixed portion fixed to the disk; a step of cutting a cylindrical inner peripheral surface of the cover portion, so that a flexible portion that allows flexure in an axial direction of the turbine is formed integrally with the cover portion; a step of fixing the fixed portion to a predetermined jig; and a step of cutting a cylindrical outer peripheral surface of the cover portion.

The manufacturing method of a cooling passage cover can manufacture the cooling passage cover according to the present invention.

According to still another aspect of the present invention, a gas turbine in which a combustor supplies fuel to compressed air compressed by a compressor to burn the fuel and generate combustion gas, and combustion gas is supplied to a turbine to obtain power, the gas turbine comprises a cover of a cooling passage, the cover includes, in a mode where a cooling passage for supplying cooling air to a turbine rotor blade via inside of a rotor of the turbine is formed, a cylindrical cover portion that covers a cavity provided in a annular pattern in an outer circumference of a disk of the turbine in a mode where a first passage opened from inside of the disk to the cavity and a second passage opened from a cooled part of the turbine rotor blade to the cavity are connected to each other, and a flexible portion that is formed integrally with the cover portion and allows flexure in an axial direction of the turbine.

In the gas turbine, even if distortion due to a temperature difference or deformation due to a centrifugal force occurs in the cavity, the cooling passage cover can absorb the distortion and the deformation, because the flexible portion of the cooling passage cover bends in the axial direction of the turbine. Therefore, as compared with conventionally assumable cooling passage covers, leakage of the cooling air can be reduced, and the cover can be used for a long time without requiring replacement parts such as a sealing member.

Advantageously, in the gas turbine, cooling air is supplied from an axial end of a turbine on a downstream side of the gas turbine to a turbine rotor blade at a last stage via inside of the rotor.

In the gas turbine, low-pressure bleed air gas can be separately supplied to the turbine rotor blade at the last stage without using high-pressure bleed air gas supplied to elements other than the turbine rotor blade at the last stage. The efficiency of the entire gas turbine can be improved, while reliably cooling the a turbine rotor blade at the last stage by the cooling air introduced from the downstream side of the rotor.

Effect of the Invention

According to the present invention, in a cooling passage for supplying cooling air to a turbine rotor blade via inside of a rotor of a turbine, leakage of the cooling air can be reduced and a cooling passage cover can be used for a long time without requiring replacement parts.

EXPLANATIONS OF LETTERS OR NUMERALS

Figure 1:
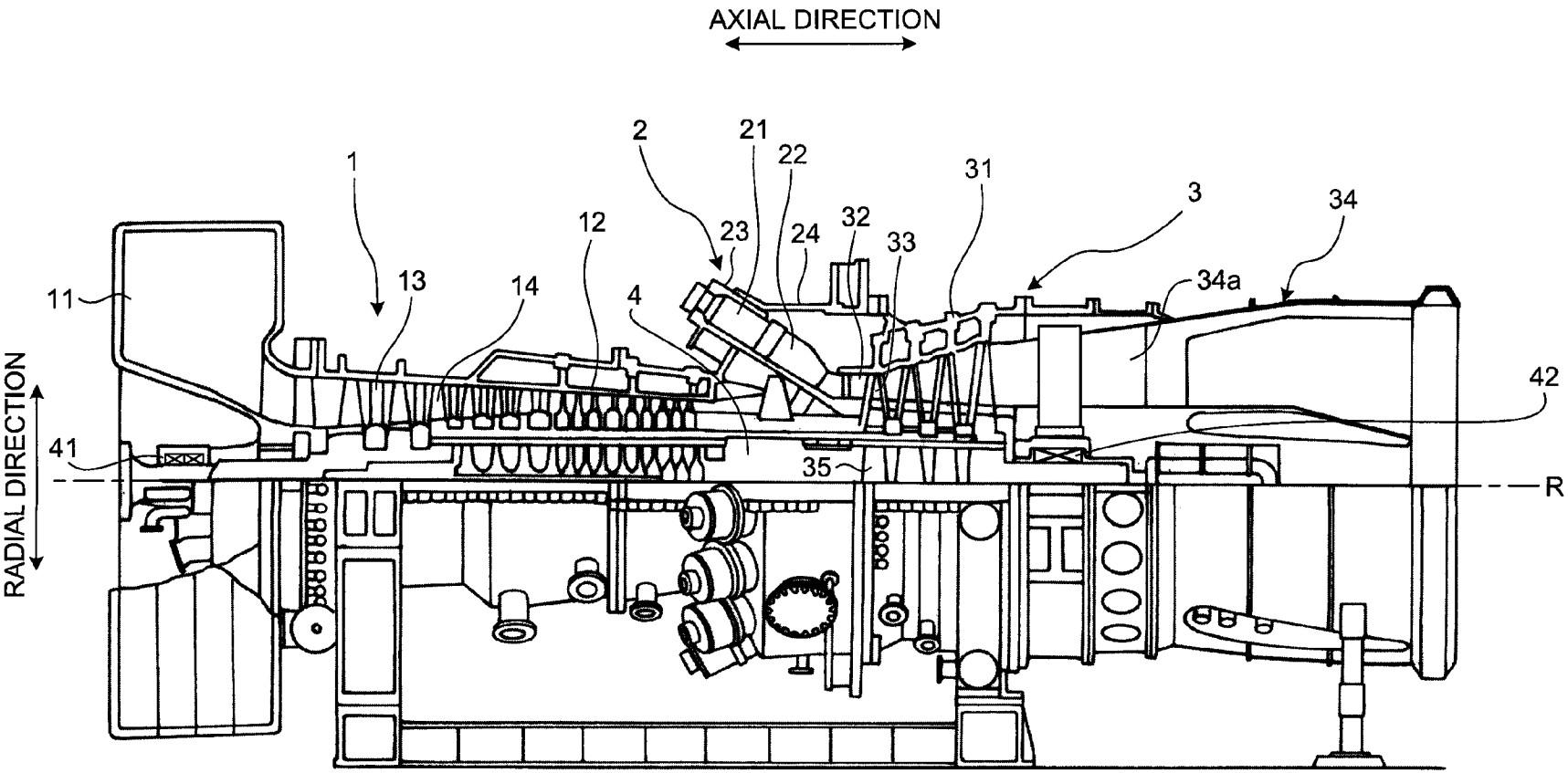
FIG. 1 is a schematic configuration diagram of a gas turbine according to an embodiment of the present invention.

1 compressor
2 combustor
3 turbine
31 turbine casing
32 turbine nozzle
33 turbine rotor blade
33*a* last-stage turbine rotor blade
34 exhaust chamber
34*a* exhaust diffuser
35 disk
4 rotor
4*a* flat surface
4*b* flat surface
4*c* depression
4' jig
41, 42 bearing unit
5 cooling passage
51 first passage
52 second passage
53 cavity
54, 54' cooling passage cover
541 cover portion

542*a* drain hole
542 flexible portion
543 fixing unit
543*a* flat surface
543*b* engaging unit
543*c* bolt
543*d* bolt hole
R central axis

BEST MODE(S) FOR CARRYING OUT THE INVENTION

Exemplary embodiments of a cooling passage cover, a manufacturing method of the cooling passage cover, and a gas turbine according to the present invention will be explained below in detail with reference to the accompanying drawings. The present invention is not limited to the embodiments.

Figure 2:
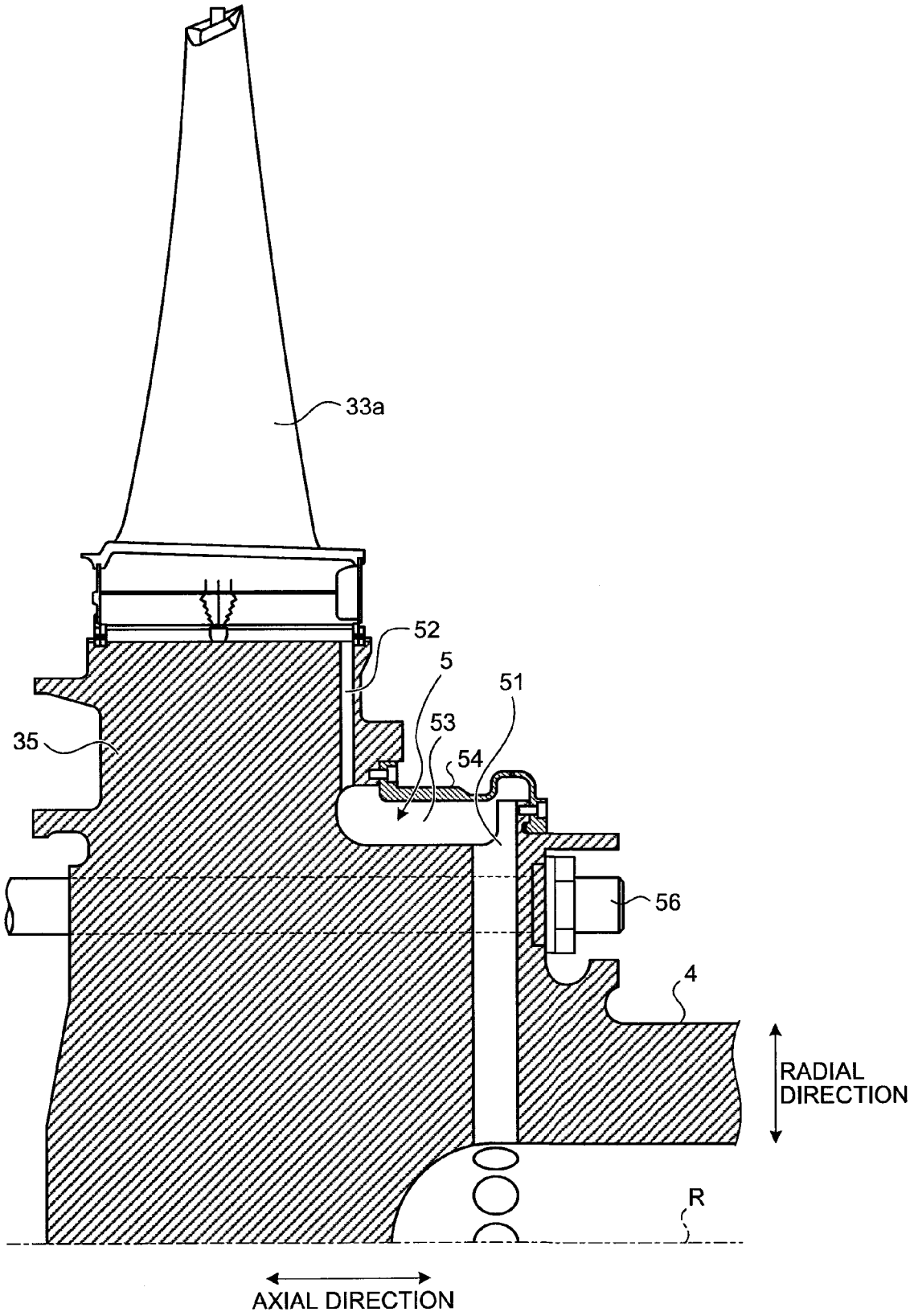
FIG. 2 is a schematic configuration diagram of a cooling passage in the gas turbine shown in FIG. 1.
Figure 3:
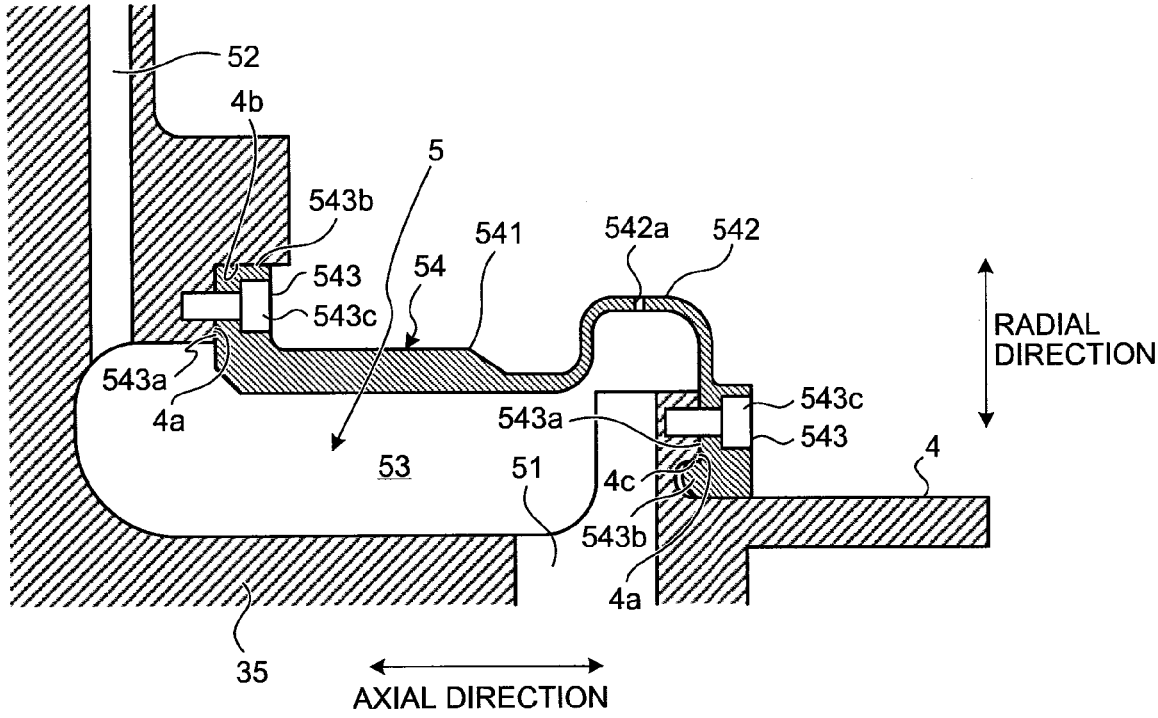
FIG. 3 is a schematic configuration diagram of a cover of a cooling passage that forms the cooling passage shown in FIG. 2.
Figure 4A:
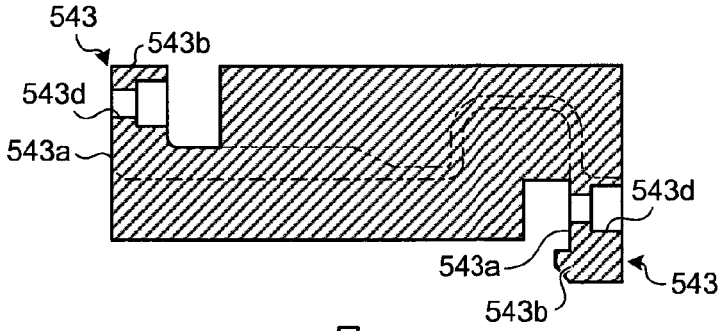
FIG. 4 is a schematic diagram of a manufacturing process of the cover of a cooling passage.
Figure 4B:
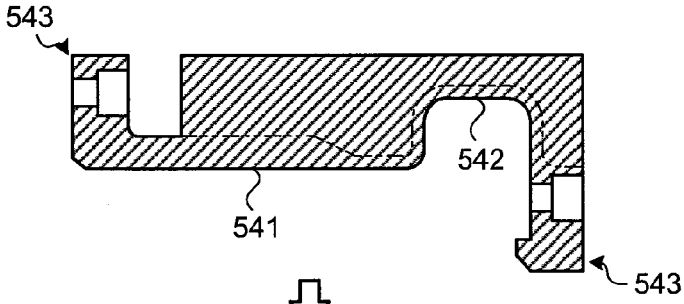
Figure 4C:
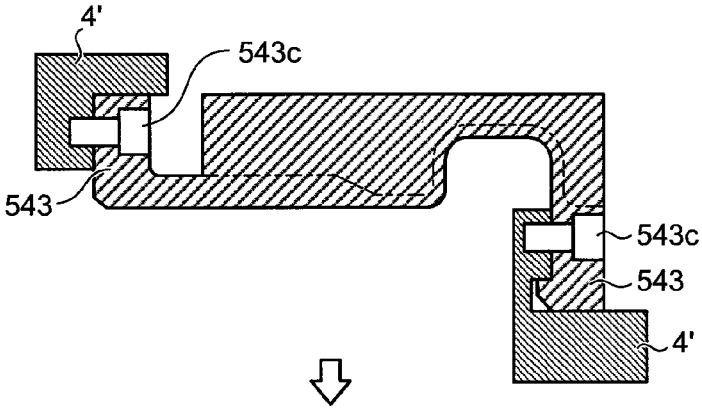
Figure 4D:
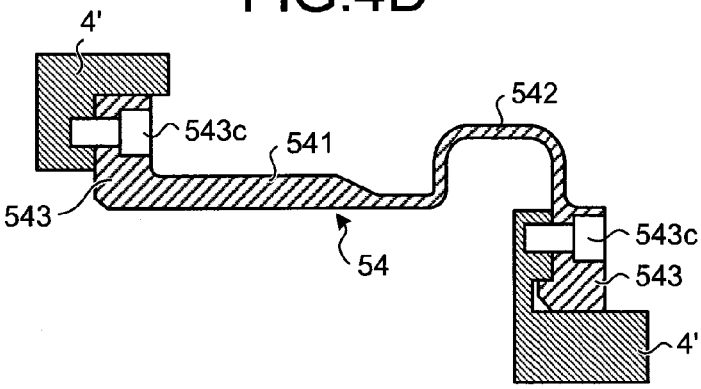

FIG. 1 is a schematic configuration diagram of a gas turbine according to an embodiment of the present invention, FIG. 2 is a schematic configuration diagram of a cooling passage in the gas turbine shown in FIG. 1, and FIG. 3 is a schematic configuration diagram of a cover of a cooling passage that forms the cooling passage shown in FIG. 2.

As shown in FIG. 1, the gas turbine includes a compressor 1, a combustor 2, and a turbine 3. The rotor 4 is arranged though the center of the compressor 1, the combustor 2, and the turbine 3. The compressor 1, the combustor 2, and the turbine 3 are arranged in a row along a central axis R of the rotor 4 in order from an upstream side (a front side) toward a downstream side (a rear side) of a flow of air or combustion gas. In the following explanations, an axial direction refers to a direction parallel to the central axis R, a circumferential direction refers to a circumferential direction about the central axis R, and a radial direction refers to a direction orthogonal to the central axis R.

The compressor 1 compresses air to generate compressed air. The compressor 1 includes compressor vanes 13 and compressor rotor blades 14 in a compressor casing 12 having an air inlet 11 for taking in air. A plurality of compressor vanes 13 are attached to the compressor casing 12 and arranged in rows in the circumferential direction. The plurality of compressor rotor blades 14 are attached to a compressor disk and arranged in rows in the circumferential direction. These compressor vanes 13 and compressor rotor blades 14 are alternately provided along the axial direction.

The combustor 2 supplies fuel to compressed air compressed by the compressor 1 to generate high-temperature and high-pressure combustion gas. The combustor 2 includes an inner cylinder 21 that mixes and burns the compressed air and fuel as a combustion cylinder, a transition piece 22 that guides combustion gas from the inner cylinder 21 to the turbine 3, and an outer casing 23 that covers an outer circumference of the inner cylinder 21 and guides compressed air from the compressor 1 to the inner cylinder 21. A plurality of (for example, 16) combustors 2 are arranged in a row in the circumferential direction with respect to a combustor casing 24.

The turbine 3 generates rotative power by the combustion gas burned in the combustor 2. The turbine 3 includes a turbine nozzle 32 and a turbine rotor blade 33 in a turbine casing 31. A plurality of turbine nozzles 32 are attached to the turbine casing 31 and arranged in rows in the circumferential direction. A plurality of turbine rotor blades 33 are fixed to the outer circumference of a plate-shaped disk centering on the central axis R of the rotor 4 and arranged in rows in the circumferential direction. These turbine nozzles 32 and turbine rotor blades 33 are alternately provided along the axial direction. An exhaust chamber 34 including an exhaust diffuser 34*a* continuous to the turbine 3 is provided on a rear side of the turbine casing 31.

The turbine rotor blades 33 are provided at a plurality of stages (four stages in this embodiment) along the axial direction. The disks 35 at the respective stages are fixed by a bolt (not shown) to constitute a part of the rotor 4. In the last-stage turbine rotor blades 33*a* on the downstream side of the flow of combustion gas, the disk 35 extends to the downstream side to constitute a part of the rotor 4 (see FIG. 2).

The disks 35 are stacked on each other to be concentric and connected by a spindle bolt 56, thereby constituting the rotor 4. The rotor 4 is rotatably provided about the central axis R, with one end thereof on the compressor 1 side being supported by a bearing unit 41, and an end thereof on the exhaust chamber 34 side being supported by a bearing unit 42. A drive shaft of a power generator (not shown) is connected to the end of the rotor 4 on the exhaust chamber 34 side.

In such a gas turbine, air taken in from the air inlet 11 of the compressor 1 passes through the compressor vanes 13 and the compressor rotor blades 14 and is compressed, to become high-temperature and high-pressure compressed air. Fuel is supplied to the compressed air from the combustor 2 to generate high-temperature and high-pressure combustion gas. The combustion gas passes through the turbine nozzles 32 and the turbine rotor blades 33 of the turbine 3 to rotate the rotor 4, and the rotative power is provided to the power generator connected to the rotor 4 to generate power. Exhaust gas after rotating the rotor 4 is released into the atmosphere, with dynamic pressure thereof being converted to static pressure by the exhaust diffuser 34*a* in the exhaust chamber 34.

In the gas turbine having such a configuration, the temperature of combustion gas acting on the turbine rotor blades 33 is high. Therefore, compressed air is taken from the compressor 1 to outside, the air is cooled by an external cooler (not shown) to generate cooling air, and the turbine rotor blades 33 are cooled by supplying the cooling air to the turbine rotor blades 33.

In a well-known gas turbine, because the temperature of the combustion gas drops up to 700° C. due to expansion of the combustion gas in the last-stage turbine rotor blades 33*a* on the downstream side of the turbine, the last-stage turbine rotor blades 33*a* are not cooled. Recently, however, the last-stage turbine rotor blades 33*a* need to be cooled due to temperature rise accompanying further improvement in efficiency of the gas turbine. Further, when the last-stage turbine rotor blades 33*a* are to be cooled, because combustion gas expands to drop the pressure near the last-stage turbine rotor blades 33*a*, air with equal pressure is taken to outside from a middle of the compressor 1 to generate cooling air by an external cooler (not shown), and the cooling air is supplied to the last-stage turbine rotor blades 33*a*.

The cooling passage 5 for supplying cooling air from the external cooler (not shown) to the last-stage turbine rotor blades 33*a* has such a configuration that cooling air is supplied from a turbine axial end on the downstream side (the rear side) of the last-stage turbine rotor blades 33*a* via the rotor 4. As shown in FIG. 2, in the cooling passage 5, a plurality of the first passages 51 extending from the central part of the disk 35 radially outward (in a radiation direction) are opened and formed in the cavity 53 provided in a annular pattern along the outer circumference of the disk 35. In the cooling passage 5, further, a plurality of second passages 52 open from a cooled part of the respective last-stage turbine rotor blades 33*a* (a space for cooling the last-stage turbine rotor blades 33*a*) to the cavity 53 are formed in the disk 35 that fixes the last-stage turbine rotor blades 33*a*, extending in the radial direction (the radiation direction). The cooling passage 5 is provided with a cylindrical cooling passage cover 54 that covers the cavity 53 from the outer circumference of the disk 35 so as to connect the respective passages 51 and 52.

The cooling passage cover 54 includes, as shown in FIG. 3, a cover portion 541 and a flexible portion 542. The cover portion 541 covers an opening of the cavity 53, and is cylindrically formed along the outer circumference of the disk 35.

The cover portion 541 is provided with a fixing unit 543 that fixes the cooling passage cover 54 to the disk 35. The fixing unit 543 is provided at a front end and a rear end of the cylindrical cover portion 541, respectively, and includes a flat surface 543*a* respectively joined with a flat surface 4*a* of the disk 35 facing rearward. The fixing unit 543 further includes an engaging unit 543*b* that radially engages with the disk 35. The engaging unit 543*b* at a front side is formed as a flat surface joined with a flat surface 4*b* of the disk 35 facing the central axis side in the radial direction, and the engaging unit 543*b* at a rear side is formed as a protrusion fitted in a depression 4*c* provided in the flat surface 4*a* of the disk 35. The fixing unit 543 fixes the cylindrical front end and rear end of the cover portion 541 to the disk 35 by a bolt 543*c*, respectively, in a state where the respective flat surfaces 543*a* are joined with the flat surface 4*a* of the disk 35 and the respective engaging units 543*b* engage with the rotor 4.

The flexible portion 542 is formed integrally with the cover portion 541. A peripheral wall of the cover portion 541 bulges radially outward (in a direction away from the central axis R) to form the flexible portion 542 along the circumferential direction of a cylindrical shape, and the flexible portion 542 is formed thinner than the cover portion 541. That is, the flexible portion 542 has a diaphragm structure, and is provided in a bendable manner in the axial direction. The flexible portion 542 is provided radially outward of a portion of the disk 35 where the rear-side fixing unit 543 of the cover portion 541 is fixed. A drain hole 542*a* is provided in the bulging part of the flexible portion 542. A plurality of drain holes 542*a* (four, for example) are provided in the circumferential direction of the flexible portion 542.

In such a configuration, because the cooling passage 5 is divided into the first passage 51 and the second passage 52, and the respective passages are formed short in the radial direction, a decrease in the strength of the disk 35 can be prevented. In the cooling passage 5 constituted as shown in FIGS. 2 and 3, because a temperature difference between the upstream side (the front side) and the downstream side (the rear side) of the flow of combustion gas in the turbine centering on the cavity 53 is large, distortion occurs in the cavity 53 in an axial direction of the turbine. Further, because opposite ends of the rotor 4 are supported by the bearing units 41 and 42 and the central part of the rotor 4 deforms in the radial direction due to a centrifugal force, the upstream side and the downstream side of the cavity 53 present in the outer circumference of the disk 35 deform so as to approach or to be separated from each other in the axial direction of the turbine.

Figure 6:
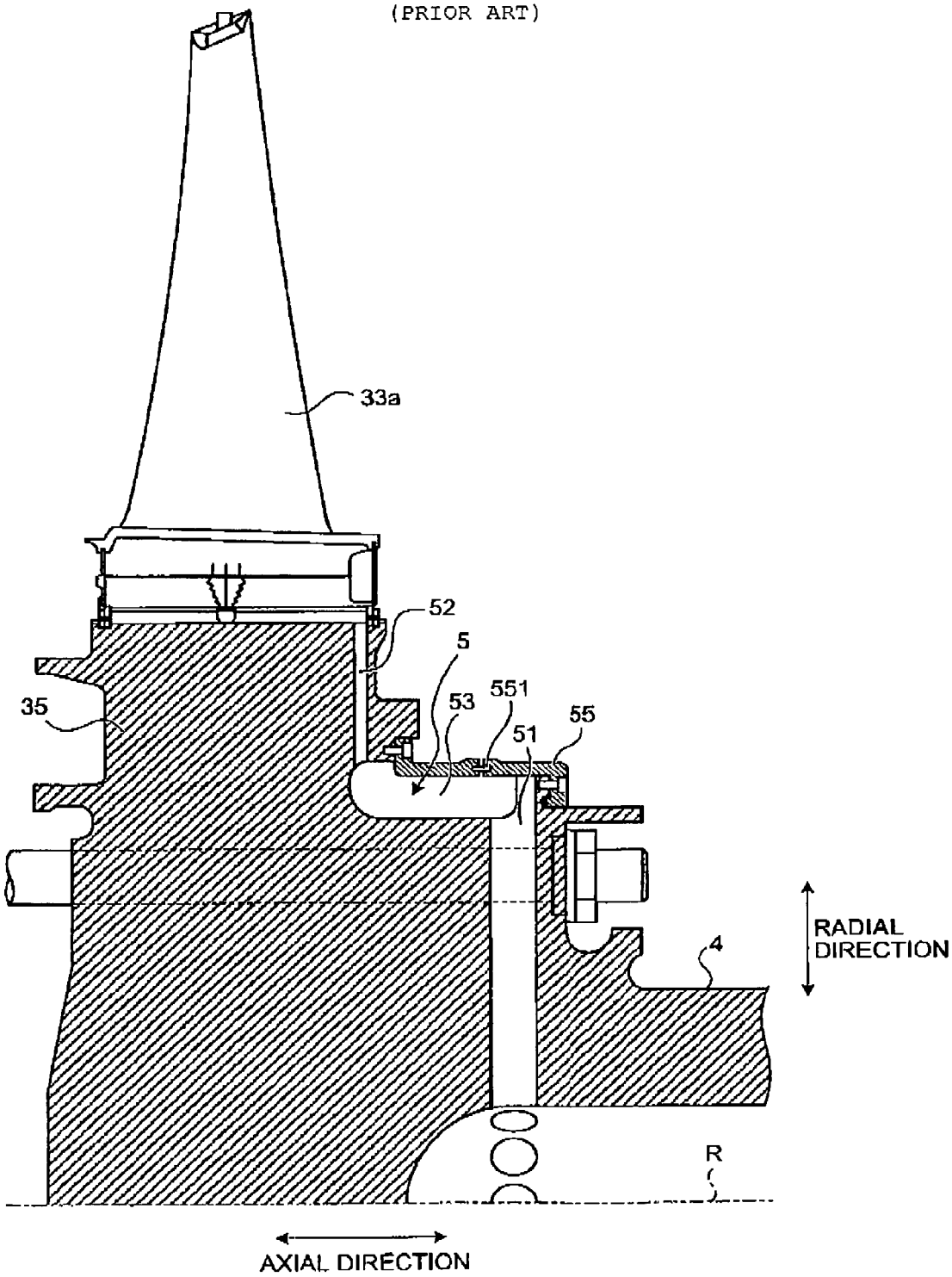
FIG.6 (PRIOR ART)
FIG. 6 is a schematic configuration diagram of a conventionally assumable cooling passage cover.

In this regard, according to the cooling passage cover 54 and the gas turbine with the above configuration, because the flexible portion 542 bends in the axial direction of the turbine, even if distortion due to the temperature difference or deformation due to the centrifugal force occurs in the cavity 53, these can be absorbed. Therefore, leakage of the cooling air can be reduced and the cooling passage cover 54 can be used for a long time without requiring replacement parts such as a sealing member 551, as compared with the cooling passage cover 55 shown in FIG. 6. For example, there is 0.013% of leakage of cooling air in the cooling passage cover 55 shown in FIG. 6, whereas there is only 0.003% of leakage of cooling air in the cooling passage cover 54 having the configuration described above. Therefore, the efficiency of the combined cycle can be improved by suppressing leakage of cooling air by 0.010 point.

The flexible portion 542 is provided radially outward of a part of the disk 35 where the rear-side fixing unit 543 of the cover portion 541 is fixed, and bulging radially outward. Therefore, at the time of fitting the cooling passage cover 54 to the disk 35, even if the cooling passage cover 54 is inserted along the central axis R of the disk 35 from the rear side of the disk 35, the flexible portion 542 does not interfere, and the cooling passage cover 54 can be fixed from the rear side of the disk 35 by the bolt 543*c*, thereby facilitating fitting of the cooling passage cover 54.

The inner peripheral surface of the cooling passage cover 54 is cooled by cooling air, and water vapor in the cooling air becomes droplets due to dew condensation and the droplets adhere to the inner peripheral surface. The droplets accumulate in the bulging part of the flexible portion 542. In this regard, in the present embodiment, because the drain holes 542*a* are provided in the bulging part of the flexible portion 542, the droplets adhered to the inner peripheral surface of the cooling passage cover 54 can be discharged from the drain holes 542*a*.

Further, in the gas turbine described above, cooling air is supplied from the axial end of the turbine on the downstream side of the gas turbine to the last-stage turbine rotor blades 33*a* inside of the rotor 4. According to such a configuration, low-pressure bleed air gas can be separately supplied to the last-stage turbine rotor blades 33*a* without using high-pressure bleed air gas supplied to elements other than the last-stage turbine rotor blades 33*a*. The efficiency of the entire gas turbine can be improved, while the last-stage turbine rotor blades 33*a* are reliably cooled by cooling air introduced from the downstream side of the rotor 4.

FIG. 4 is a schematic diagram of a manufacturing process of the cooling passage cover. In FIG. 4, a partial sectional view of the cylindrical cooling passage cover 54 is shown. First, a base material formed of a forging material is formed in a roughly cylindrical shape, and the fixing unit 543 to be fixed to the disk 35 is cut. In the fixing unit 543, a bolt hole 543*d* for inserting the bolt 543*c* is cut together with the flat surface 543*a* and the engaging unit 543*b* (see FIG. 4(*a*)).

The cylindrical inner peripheral surface is cut next. The inner peripheral surface of the cover portion 541 and the flexible portion 542 is cut so that the flexible portion 542 is formed integrally with the cover portion 541, while rotating the base material about the central axis R (not shown) (see FIG. 4(*b*)).

The fixing unit 543 is then fixed to a predetermined jig 4' by the bolt 543*c*. The jig 4' can be a jig for exclusive use for manufacturing the cooling passage cover, or can be the disk 35 itself to which the cooling passage cover 54 is fitted (see FIG. 4(*c*)).

The cylindrical outer peripheral surface is cut next. At this time, the outer peripheral surface of the cover portion 541 and the flexible portion 542 is cut, while rotating the jig 4' about the central axis R (not shown) (see FIG. 4(*d*)).

Although not shown in the drawings, the cooling passage cover 54 is manufactured by cutting the drain holes 542*a* at last.

According to the manufacturing method, the cooling passage cover 54 described above can be manufactured, and particularly, the thin part of the flexible portion 542 can be manufactured accurately by cutting a bulging inner peripheral surface first.

Figure 5:
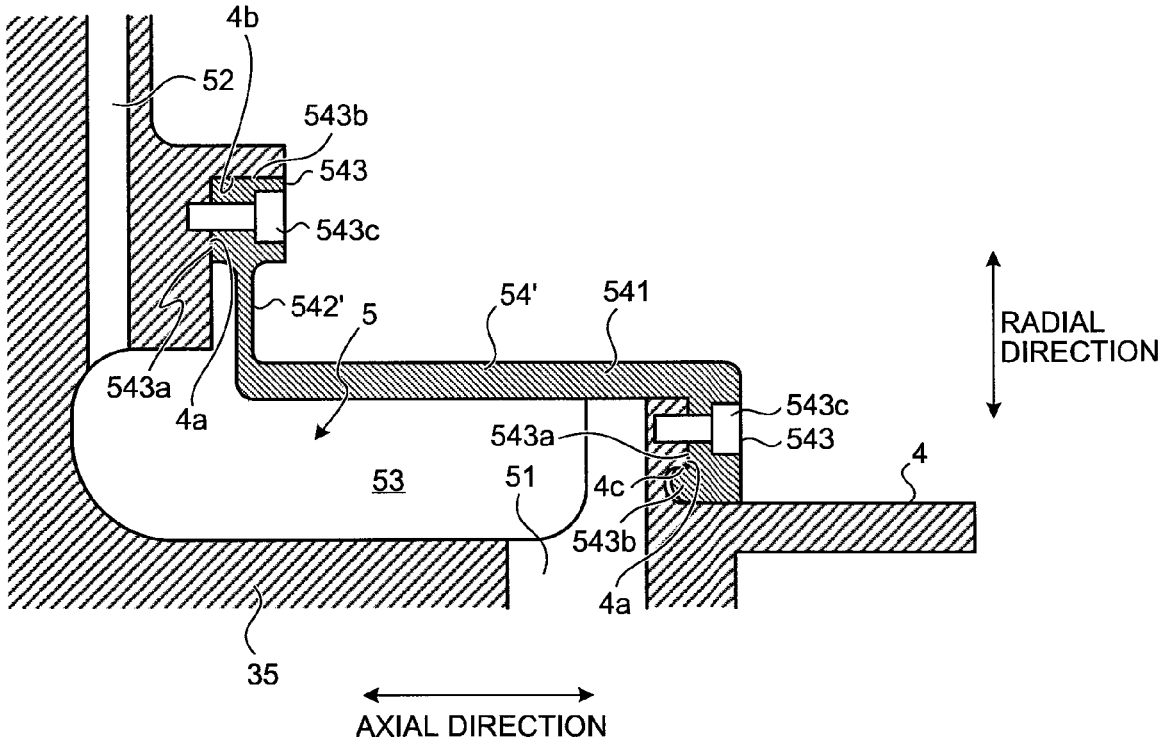
FIG. 5 is a schematic configuration diagram of a cooling passage cover having a different configuration.

FIG. 5 is a schematic configuration diagram of a cooling passage cover having a different configuration. As shown in FIG. 5, a cooling passage cover 54' having a different configuration is different from the cooling passage cover 54 shown in FIG. 3 in a configuration of the flexible portion. At the front end of the cover portion 541, a peripheral wall of the cover portion 541 extends radially outward in a non-contact state with the disk 35, to form a flexible portion 542' thinner than the cover portion 541. That is, the flexible portion 542' has a bellows structure, and is provided in a bendable manner in the axial direction of the turbine.

According to the cooling passage cover 54' and the gas turbine having such a configuration, because the flexible portion 542' bends in the axial direction of the turbine, even if distortion due to the temperature difference or deformation due to the centrifugal force occurs in the cavity 53, these can be absorbed. Therefore, leakage of the cooling air can be reduced and the cooling passage cover 54 can be used for a long time without requiring replacement parts such as the sealing member 551, as compared with the cooling passage cover 55 shown in FIG. 6. Because the flexible portion 542' does not have a configuration bulging radially outward as the flexible portion 542 shown in FIG. 3, droplets due to dew condensation do not accumulate. Therefore, the drain holes 542*a* are not required, and even minute leakage of cooling air due to provision of the drain holes 542*a* can be prevented. The cooling passage cover 54' in this mode can be applied according to the property of cooling air.

INDUSTRIAL APPLICABILITY

As described above, according to the cooling passage cover, the method of manufacturing the cover, and the gas turbine of the present invention, in a cooling passage for supplying cooling air to turbine rotor blades via inside of a rotor of a turbine, leakage of cooling air can be reduced, and the cooling passage cover can be used for a long time without requiring replacement parts.

The invention claimed is:

1. A cover for a cooling passage for supplying cooling air to a turbine rotor blade via inside of a disk of a turbine, the cover comprising:

a cylindrical cover portion for covering a cavity provided in annular pattern in an outer circumference of the disk, wherein a first passage opened radially outward from inside of the disk to the cavity and a second passage opened from the turbine rotor blade to the cavity are connected to each other; and a flexible portion that is formed integrally with the cover portion and covering the cavity, the flexible portion is formed thinner than the cover portion in order to allow flexure in an axial direction of the turbine.

2. The cover of a cooling passage according to claim 1, wherein the flexible portion is formed by a peripheral wall of the cover portion bulging radially outward.

3. The cover of a cooling passage according to claim 1, wherein the flexible portion is formed by a peripheral wall of the cover portion extending radially outward.

4. A cover for a cooling passage for supplying cooling air to a turbine rotor blade via inside of a disk of a turbine, the cover comprising:

a cylindrical cover portion that covers a cavity provided in an annular pattern in an outer circumference of the disk, wherein a first passage opened from inside of the disk to the cavity and a second passage opened from the turbine rotor blade to the cavity are connected to each other; and a flexible portion that is formed integrally with the cover portion and allows flexure in an axial direction of the turbine, wherein the flexible portion is formed by a peripheral wall of the cover portion bulging radially outward, and wherein a drain hole is provided in the bulging part.

5. A gas turbine having a combustor for supplying fuel to air compressed by a compressor to burn the fuel and generate combustion gas, and combustion gas is supplied to a turbine to obtain power, the gas turbine comprises a cover of a cooling passage, wherein the cover includes a cylindrical cover portion that covers a cavity provided in an annular pattern in an outer circumference of a disk of the turbine in order to form a cooling passage for supplying cooling air to a turbine rotor blade via inside of a rotor of the turbine wherein a first passage opened radially outward from inside of the disk to the cavity and a second passage opened from the turbine rotor blade to the cavity are connected to each other, and a flexible portion that is formed integrally with the cover portion and covering the cavity, the flexible portion is formed thinner than the cover portion in order to allow flexure in an axial direction of the turbine.

6. The gas turbine according to claim 5, wherein cooling air is supplied from an axial end of the turbine on a downstream side of the gas turbine to the turbine rotor blade at a last stage via inside of the rotor.

7. A cover for a cooling passage for supplying cooling air to a turbine rotor blade via inside of a disk of a turbine, comprising:

a tubular cover portion for covering a cavity provided in an annular pattern in an outer circumference of the disk, wherein a first passage opened radially outward from inside of the disk to the cavity and a second passage opened from the turbine rotor blade to the cavity are connected to each other; and a flexible portion integrally formed with the cover portion and covering the cavity, wherein the flexible portion is thinner than the cover portion thereby allowing flexure in an axial direction of the turbine.

* * * * *